US012031438B2

(12) United States Patent
Goodwin et al.

(10) Patent No.: US 12,031,438 B2
(45) Date of Patent: Jul. 9, 2024

(54) CUTTER HEAD ARRANGEMENT

(71) Applicant: MASTER SINKERS (PTY) LTD., Gauteng (ZA)

(72) Inventors: Nicolaas Bodenstein Goodwin, Gauteng (ZA); Barend Jacobus Jordaan, Gauteng (ZA)

(73) Assignee: MASTER SINKERS (PTY) LTD., Gauteng (ZA)

( * ) Notice: Subject to any disclaimer, the term of this patent is extended or adjusted under 35 U.S.C. 154(b) by 387 days.

(21) Appl. No.: 17/413,849

(22) PCT Filed: Dec. 11, 2019

(86) PCT No.: PCT/IB2019/060651
§ 371 (c)(1),
(2) Date: Jun. 14, 2021

(87) PCT Pub. No.: WO2020/121212
PCT Pub. Date: Jun. 18, 2020

(65) Prior Publication Data

US 2022/0056801 A1 Feb. 24, 2022

(30) Foreign Application Priority Data

Dec. 12, 2018 (ZA) ..... 2018/08367

(51) Int. Cl.
*E21D 9/11* (2006.01)
*E21B 7/28* (2006.01)
(Continued)

(52) U.S. Cl.
CPC ..... *E21D 9/112* (2013.01); *E21B 10/12* (2013.01); *E21B 10/265* (2020.05); *E21B 10/28* (2013.01);
(Continued)

(58) Field of Classification Search
CPC . E21D 9/112; E21D 1/06; E21B 10/12; E21B 10/265; E21B 10/28; E21B 10/627; E21B 27/005; E21B 7/28
See application file for complete search history.

(56) References Cited

U.S. PATENT DOCUMENTS 2,264,440 A * 12/1941 Havlick ..... E21B 10/46 175/434
3,379,264 A 4/1968 Cox
(Continued)

FOREIGN PATENT DOCUMENTS

| | | | |
|---|---|---|---|
| CN | 102400647 | A | 4/2012 |
| JP | 9-105295 | A | 4/1997 |
| JP | 2017-128843 | A | 7/2017 |

OTHER PUBLICATIONS

International Search Report dated Feb. 17, 2020 for Application No. PCT/IB2019/060651.
(Continued)

*Primary Examiner* — Jonathan Malikasim
(74) *Attorney, Agent, or Firm* — Ladas & Parry LLP

(57) ABSTRACT

A cutter head arrangement comprising a cutter head portion including a cutter head side wall to define a chamber (or cavity) surrounded by the cutter head side wall. A substantially circular rim portion extends from (a distal end of) the cutter head side wall, the rim portion defining a working, contact face of the cutter head portion. A recessed wall portion extends away from the rim portion inwardly into the chanber so as to be surrounded by the cutter head side wall, with the rim portion and/or the recessed wall portion being fitter with a plurality of cutter elemenets, to enable the cutter head portion to blind bore a pilot hole in use. The recessed wall portion that extends away from the rim portion inwardly into the chamber is a substantially conical body so as to define a conical recess.

15 Claims, 10 Drawing Sheets

(51) Int. Cl.

| | |
|---|---|
| ***E21B 10/12*** | (2006.01) |
| ***E21B 10/26*** | (2006.01) |
| ***E21B 10/28*** | (2006.01) |
| ***E21B 10/627*** | (2006.01) |
| ***E21B 27/00*** | (2006.01) |

(52) U.S. Cl.
CPC ..... *E21B 10/627* (2013.01); *E21B 27/005* (2013.01); *E21B 7/28* (2013.01)

(56) References Cited

U.S. PATENT DOCUMENTS

| | | | | |
|---|---|---|---|---|
| RE32,036 E * | 11/1985 | Dennis | E21B 10/61 175/429 |
| 5,022,789 A | 6/1991 | Miyazaki et al. | |
| 6,170,576 B1 * | 1/2001 | Brunnert | E21B 29/00 166/55.6 |

OTHER PUBLICATIONS

Written Opinion dated Feb. 17, 2020 for Application No. PCT/IB2019/060651.
International Preliminary Report on Patentability dated Nov. 23, 2020 for Application No. PCT/IB2019/060651.
Espacenet English abstract of JP 2017-128843 A.
Espacenet English abstract of JP 9-105295 A.

* cited by examiner

CUTTER HEAD ARRANGEMENT

RELATED APPLICATION

This application is an application under 35 U.S.C. 371 of International Application No. PCT/IB2019/060651 filed on Dec. 11, 2019, which claims the benefit of South African Provisional Patent Application No. 2018108367 filed on Dec. 12, 2018, the entire contents of each of which are incorporated herein by reference.

FIELD OF INVENTION

THIS invention relates to a cutter head arrangement, typically for use in the mining or civil industries. In one version, the cutter head arrangement may be fitted to a shaft boring machine for blind shaft boring and enlargement applications, such as production and ventilation shafts. However, the applications of the cutter head arrangement are numerous and may ultimately be used wherever a shaft/hole is required.

SUMMARY OF INVENTION

According to a first aspect of the invention there is provided a cutter head arrangement comprising a cutter head portion including a (substantially cylindrical) cutter head side wall to define a chamber (or cavity) surrounded by the cutter head side wall, with a (substantially circular) rim portion extending from (a distal end of) the cutter head side wall, the rim portion defining a working, contact face of the cutter head portion, with a recessed wall portion extending away from the rim portion inwardly into the chamber so as to be surrounded by the cutter head side wall, with the rim portion and/or the recessed wall portion being fitted with a plurality of cutter elements (to enable the cutter head portion to blind bore a pilot hole in use).

In an embodiment, the recessed wall portion that extends away from the rim portion inwardly into the chamber is a substantially conical body so as to define a conical recess (proximate a central region of the cutter head portion, at a distal end of the cutter head portion). The conical body accordingly defines an inwardly extending apex that terminates substantially in line with a central axis of the cutter head portion.

In an embodiment, the cutter elements may be arranged concentrically and/or radially on the conical body In an embodiment, the cutter head portion includes a tapering peripheral wall that extends between (the distal end of) the cutter head side wall and the rim portion, with the rim portion accordingly protruding from the cutter head side wall, so that the rim portion defines a circular ridge. In an embodiment, the tapering peripheral wall may also be fitted with cutter elements.

Advantageously, the cutter elements may be installed and replaced either from the front or the rear of (i.e. from within the chamber of) the cutter head portion.

In an embodiment, the cutter head arrangement comprises a connector portion extending from (a proximal end of) the cutter head side wall to enable the cutter head arrangement to be secured to a boring machine, such as a blind shaft boring machine, if required. Thus, in one version, the cutter head arrangement is part of a larger boring machine. However, in another version, the cutter head arrangement can be used on its own without the need for it to be connected to a boring machine. The size of the cutter head portion can also change according to requirements and is not limited to any particular size.

The connector portion includes a (substantially cylindrical) connector head side wall extending from the cutter head side wall, with an end wall extending across a (proximal) end of the connector head side wall, the end wall defining a substantially central connector aperture therein.

In an embodiment, the cutter head side wall is enlarged relative to the connector head side wall, with a step accordingly being defined between the cutter head side wall and the connector head side wall.

In an embodiment, the rim portion defines at least one material handling aperture to accommodate a pilot shaft material handling arrangement, the at least one material handling aperture extending between the contact face of the cutter head portion and the chamber (or cavity) surrounded by the cutter head side wall.

In an embodiment, the pilot shaft material handling arrangement comprises a cutter head suction pipe extending from the material handling aperture, adjacent an inner face of the conical body and then upwardly along the central axis of the cutter head portion, with the end of the cutter head suction pipe protruding from the central connector aperture of the connector portion. In an embodiment, the end of the cutter head suction pipe can be fitted with a double walled swivel arrangement that defines a first pipe that is in communication with the cutter head suction pipe and a second pipe that leads into to a cutter head blower pipe that extends up to a vacuum unit provided on the shaft boring machine (on an upper working stage of the shaft boring system).

In an embodiment, the pilot shaft material handling arrangement further comprises a kibble that acts as a vacuum collector kibble that can be lowered through the shaft boring machine and secured to the double walled swivel arrangement. The kibble includes a kibble suction pipe that is secured to the other end of the first pipe of the double walled swivel arrangement so as to be in material communication with the cutter head suction pipe, with the swivel arrangement allowing material to be sucked away from the pilot hole being bored as the cutter head arrangement rotates, via the cutter head suction pipe, and into the relatively stationary kibble via the kibble suction pipe (via the double walled swivel arrangement), where the material accumulates (as the cutter head arrangement continues to rotate).

The kibble further includes a kibble blower pipe that is secured to the other end of the second pipe of the double walled swivel arrangement so as to be in fluid communication with the cutter head blower pipe, with the kibble blower pipe directing air from an upper region of the kibble, via the kibble blower pipe, into the cutter head blower pipe, via the second pipe of the double walled swivel arrangement and out to the vacuum unit.

In an embodiment, an upper region of the kibble includes a filtering arrangement to filter the dust resulting from the material collecting within the kibble, so that relatively clean air is conveyed through the kibble blower pipe and then the cutter head blower pipe and out to the vacuum unit.

Advantageously, the distance from the cutter head portion to the cutting face is spaced to ensure that the material that is being cut/bored is of a predetermined size. This spacing, together with the spacing of the cutter elements and the number of cutter elements, is used to predetermine the size of particle/material cuttings. This combination of factors acts as a sizing guide or arrangement to enable the particle or material size to be controlled, to ultimately ensure that the suction pipe does not become blocked by overly sized particles.

In an embodiment, scraper elements can be fitted to the cutter head portion to encourage movement of cuttings to the material handling aperture/s. The scraper elements can be replaced as needed.

According to a second aspect of the invention there is provided a pilot shaft material handling arrangement for a cutter head arrangement, the cutter head arrangement comprising a rotatable cutter head portion including a working, contact face fitted with a plurality of cutter elements to enable the cutter head portion to bore a pilot hole in use, the pilot shaft material handling arrangement comprising a cutter head suction pipe extending from the working, contact face, with the end of the cutter head suction pipe being fitted with a double walled swivel arrangement that defines a first pipe that is in communication with the cutter head suction pipe and a second pipe that leads into a cutter head blower pipe that extends up to a vacuum unit provided on the shaft boring machine (on an upper working stage of the shaft boring system).

In an embodiment, the pilot shaft material handling arrangement further comprises a kibble that acts as a vacuum collector kibble that can be lowered and secured to the double walled swivel arrangement. The kibble includes a kibble suction pipe that is secured to the other end of the first pipe of the double walled swivel arrangement so as to be in material communication with the cutter head suction pipe, with the swivel arrangement allowing material to be sucked away from the pilot hole being bored as the cutter head portion rotates, via the cutter head suction pipe, and into the relatively stationary kibble via the kibble suction pipe (via the double walled swivel arrangement), where the material accumulates (as the cutter head portion continues to rotate).

The kibble further includes a kibble blower pipe that is secured to the other end of the second pipe of the double walled swivel arrangement so as to be in fluid communication with the cutter head blower pipe, with the kibble blower pipe directing air from an upper region of the kibble, via the kibble blower pipe, into the cutter head blower pipe, via the second pipe of the double walled swivel arrangement and out to the vacuum unit.

In an embodiment, an upper region of the kibble includes a filtering arrangement to filter the dust resulting from the material collecting within the kibble, so that relatively clean air is conveyed through the kibble blower pipe and then the cutter head blower pipe and out to the vacuum unit.

BRIEF DESCRIPTION OF DRAWINGS

The invention will now be further described, by way of example, with reference to the accompanying diagrammatic drawings.

In the drawings.

DETAILED DESCRIPTION OF AN EXAMPLE EMBODIMENT

The following description of the invention is provided as an enabling teaching of the invention. Those skilled in the relevant art will recognise that many changes can be made to the embodiment described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

Referring first to FIGS. 1 to 8, a cutter head arrangement 10 according to one version/application of the invention is shown. In this version/application, the cutter head arrangement 10 comprises a rear connector portion 12 to enable the cutter head arrangement 10 to be secured to a boring machine 50 (shown in FIG. 8), such as a blind shaft boring machine. Thus, in one version, the cutter head arrangement 10 is part of a larger boring machine 50. However, in another version, the cutter head arrangement 10 can be used on its own, as an individual piece of equipment, without the need for it to be connected to a boring machine.

Figure 8:
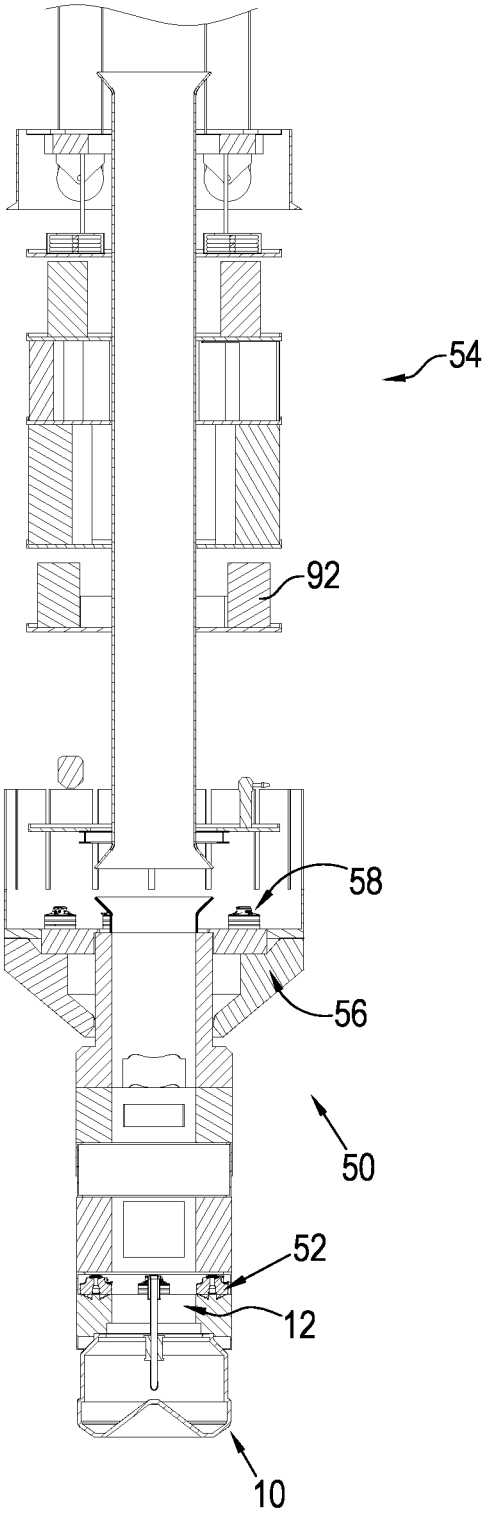
FIG. 8 shows the cutter head arrangement in relation to a boring machine, to which the cutter head arrangement may be secured in one application/version of the invention.

The cutter head arrangement 10 defines a pilot shaft cutter head of the shaft boring machine 50. A pilot shaft main drive 52 is provided to rotatingly drive the cutter head arrangement 10 relative to the boring machine 50. In one application, as shown in FIG. 8, the shaft boring machine 50 is part of a larger shaft boring system 54, of the type disclosed in WO2016/116910 and WO2018/055549. The shaft boring machine 50 includes a reamer cutter head 56 driven by a reamer main drive 58 to ream the main, enlarged shaft. The cutter head arrangement 10 extends from the lowermost end of the shaft boring machine 50 to blind bore a pilot hole, in use.

The size of the cutter head arrangement 10 can also change according to requirements and is not limited to any particular size.

Figure 1:
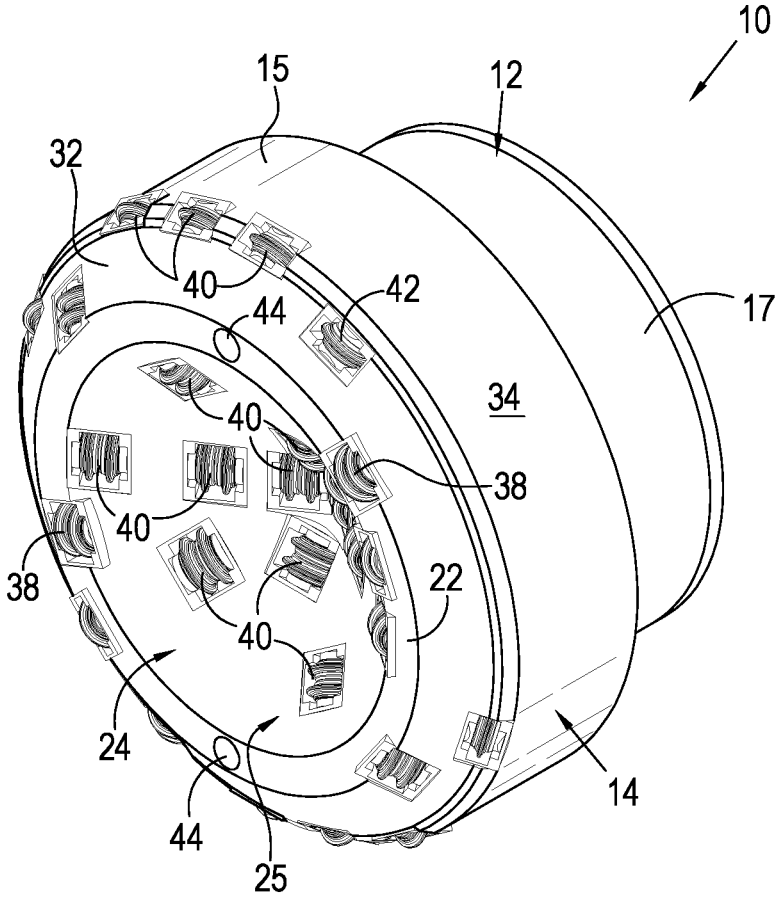
FIG. 1 shows a front perspective view of a cutter head arrangement, according to the invention.
Figure 2:
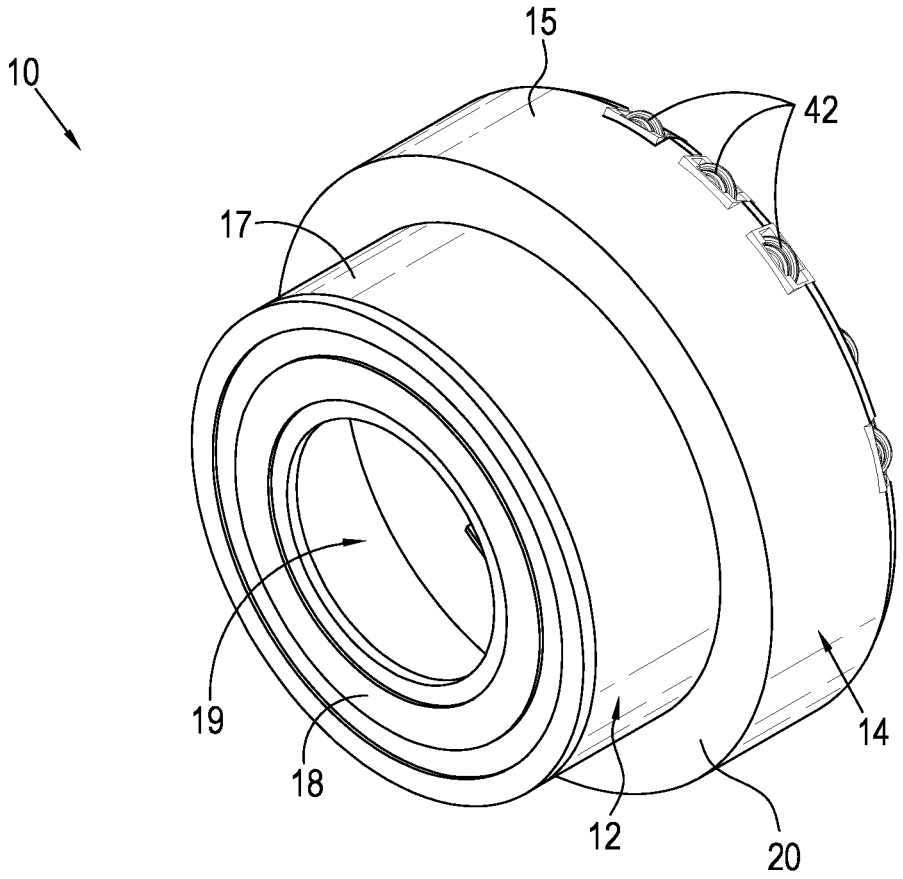
FIG. 2 shows a rear perspective view of the cutter head arrangement.
Figure 3:
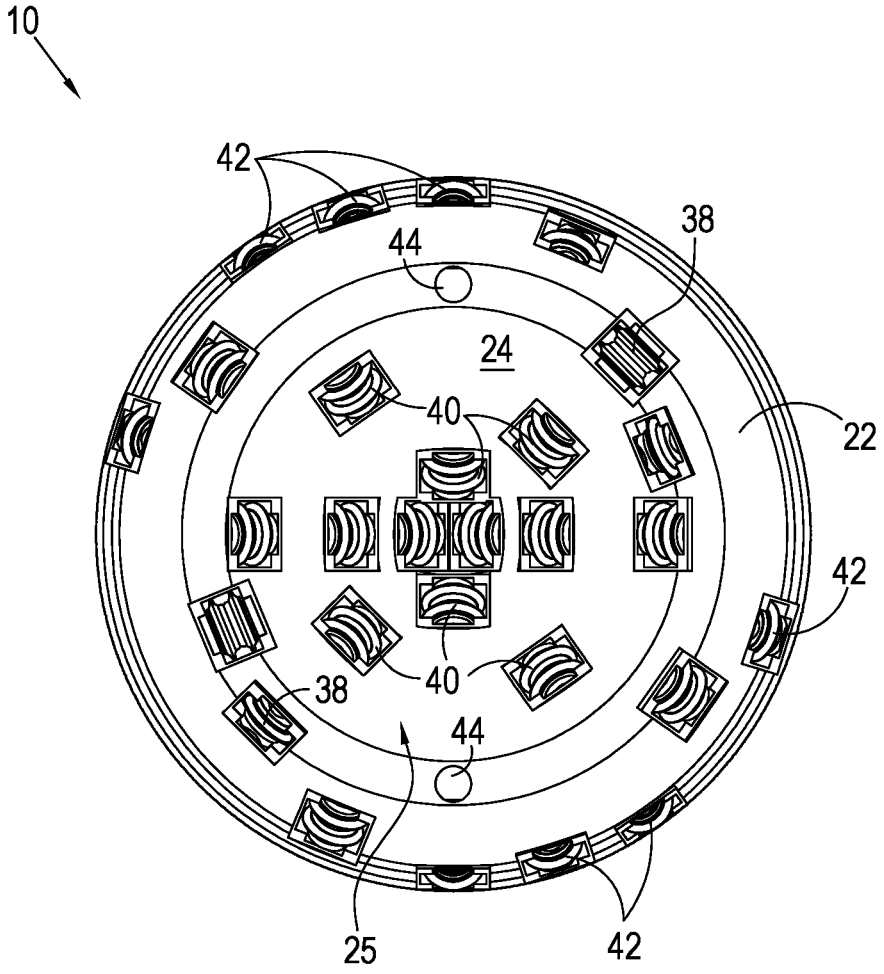
FIG. 3 shows a front view of the cutter head arrangement.
Figure 4:
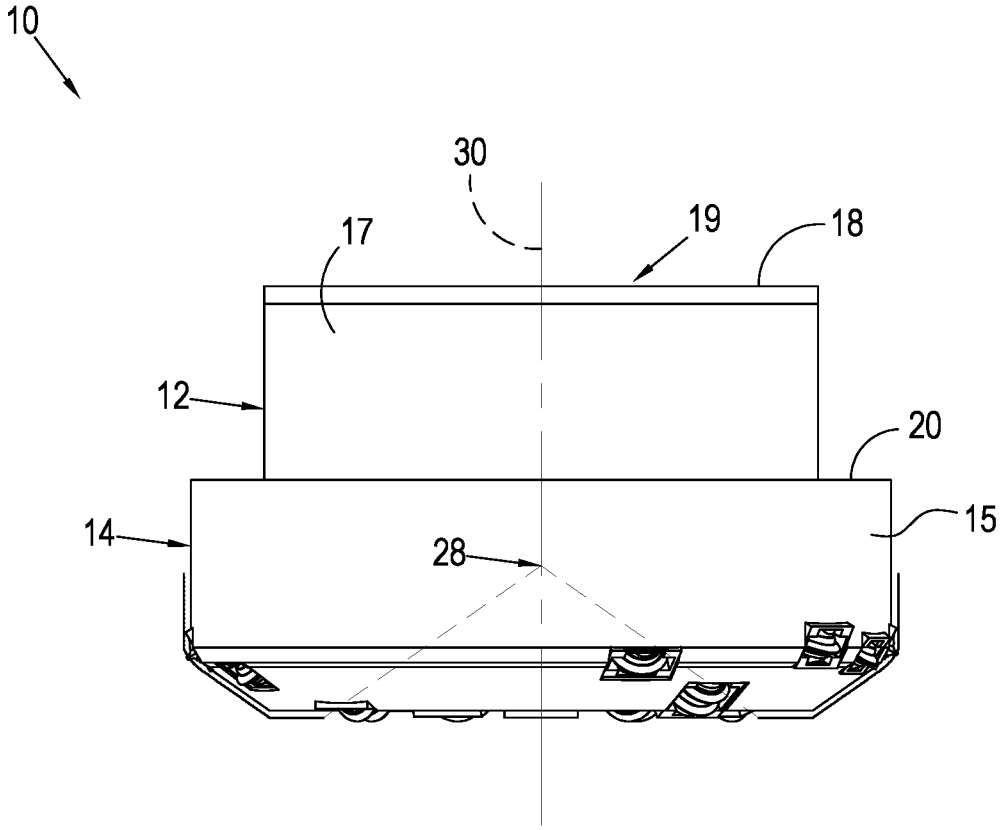
FIG. 4 shows a side view of the cutter head arrangement.
Figure 5:
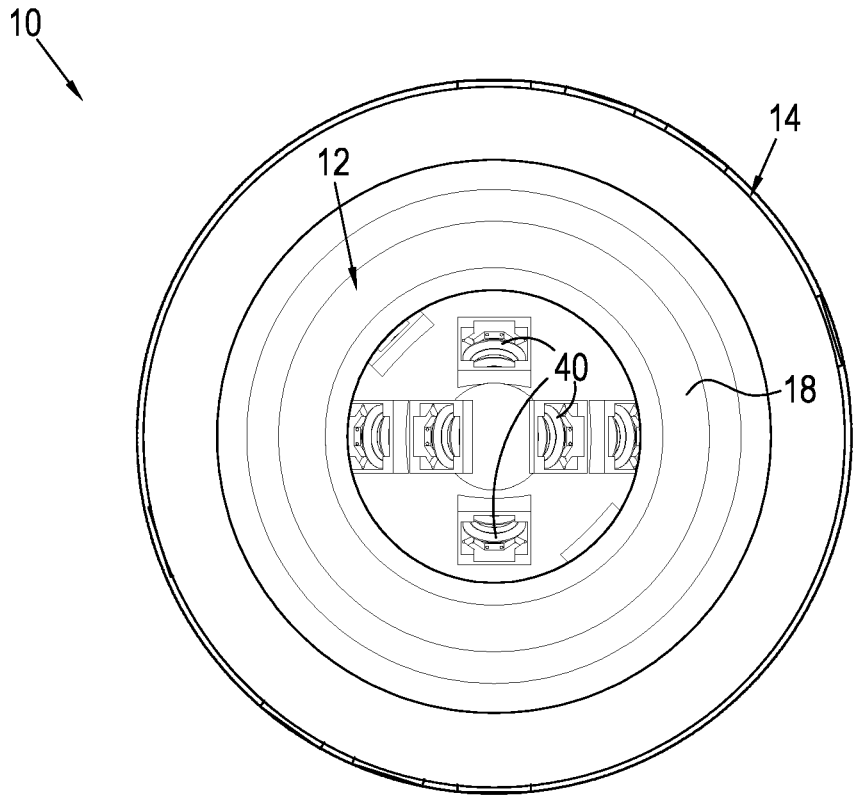
FIG. 5 shows a rear view of the cutter head arrangement.
Figure 6:
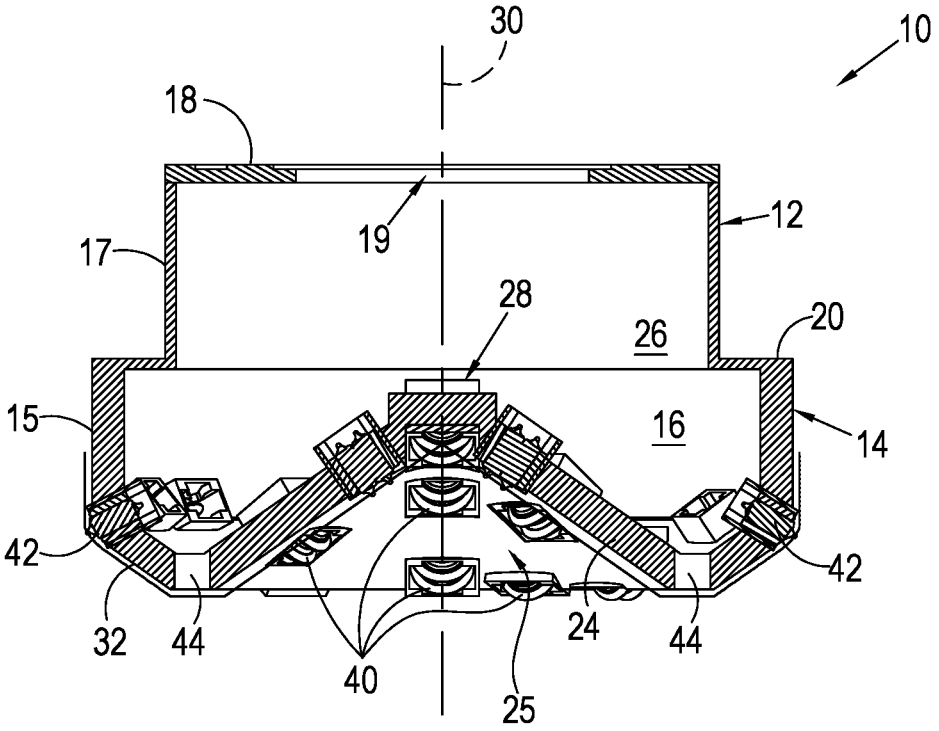
FIGS. 6 and 7 show various cross-sectional side views of the cutter head arrangement.
Figure 7:
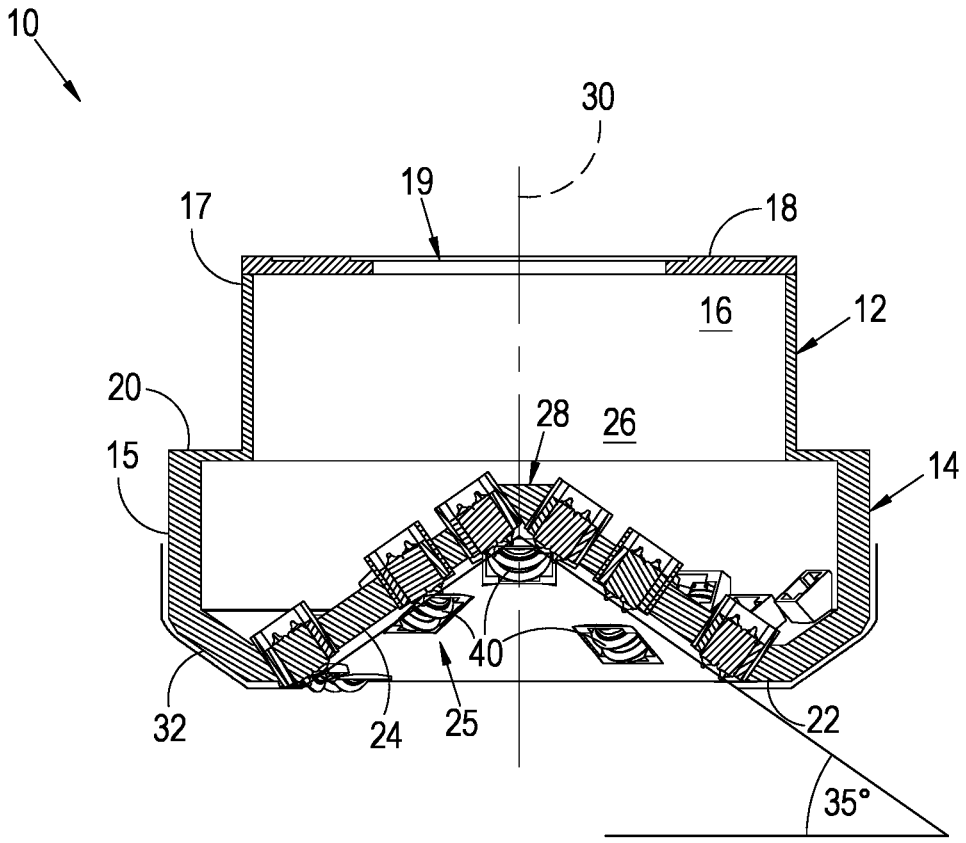

A front cutter head portion 14 extends from the rear connector portion 12. The cutter head portion 14 includes a substantially cylindrical cutter head side wall 15 to define a chamber or cavity 16, as best shown in FIGS. 6 and 7, surrounded by the cutter head side wall 15. The connector portion 12 extends from a proximal end of the cutter head side wall 15.

The connector portion 12 includes a substantially cylindrical connector head side wall 17 extending from the cutter head side wall 15. An end wall 18 extends across a proximal end of the connector head side wall 17, the end wall 18 defining a substantially central connector aperture 19 therein to facilitate the fitting of the cutter head arrangement 10 to the boring machine 50.

In an embodiment, the cutter head side wall 15 is enlarged relative to the connector head side wall 17, with a step 20 accordingly being defined between the cutter head side wall 15 and the connector head side wall 17.

The front cutter head portion 14 includes a substantially circular rim portion 22 extending from a distal end of the cutter head side wall 15. The rim portion 22 defines a working, contact face of the front cutter head portion 14.

A recessed wall portion 24, typically in the form of a conical body 24, extends away from the rim portion 22 inwardly (at an angle of 35°, for example, as best shown in FIG. 7) into the chamber 16 so as to be surrounded by the cutter head side wall 15. The conical body 24 thus defines a conical recess 25 proximate a central region of the cutter head portion 14, at a distal end of the cutter head portion 14, with the conical body 24 extending inwardly towards the interface 26 between the rear connector portion 12 and the front cutter head portion 14.

As best shown in FIGS. 6 and 7, the conical body 24 accordingly defines an inwardly extending apex 28 that terminates substantially in line with a central axis 30 of the cutter head arrangement 10.

In an embodiment, the cutter head portion 14 includes a tapering peripheral wall 32 that extends between the distal end of the cutter head side wall 15 and the rim portion 22. The rim portion 22 accordingly protrudes from the cutter head side wall 15, so that the rim portion 22 defines a circular ridge between the inwardly extending conical body 24 and the tapering peripheral wall 32.

In an embodiment, a plurality of concentric and/or radial cutter elements 38, 40, 42 are fitted on or proximate the rim portion 22 and/or the inwardly extending conical portion 24 and/or the tapering peripheral wall 32, respectively, to enable the cutter head portion 14 to blind bore a pilot hole, in use.

The cutter elements 38, 40, 42 can be installed either from the back of the cutter head portion 14 (i.e. from within the chamber or cavity 16) or from the front. The cutter elements 38, 40, 42 are typically closed off with a cover element. This cover element can have an electronic device to measure certain parameters for example the wear of the cutter element 38, 40, 42 and the working temperature. A rotary swivel that is used in the cutter head portion 14 can be used to supply the cutter head portion 14 with required fluids for example but not limited to hydraulic fluid, water and cables that can be used for intelligence and or communication.

The rim portion 22 defines at least one material handling aperture 44 to accommodate a pilot shaft material handling arrangement 80, which will be described in more detail further below, with reference to FIGS. 9 and 10. As best shown in FIGS. 7 and 8, the at least one material handling aperture 44 extends between the contact face of the rim portion 22 and the chamber 16 surrounded by the cutter head side wall 15.

Advantageously, the distance from the cutter head portion 14 to the cutting face is spaced to ensure that the material that is being cut/bored is of a predetermined size. This spacing, together with the spacing of the cutter elements 38, 40, 42 and the number of cutter elements 38, 40, 42, is used to predetermine the size of particle/material cuttings. This combination of factors acts as a sizing guide or arrangement to enable the particle or material size to be controlled, to ultimately ensure that a suction pipe 82 (described further below) does not become blocked by overly sized particles. To achieve this, in one version, a cutter element can be installed in front of the material handling aperture 44 to ensure that the material that is handled through the aperture 44 is an appropriate size to prevent blockages.

In an embodiment, scraper elements can be fitted to the cutter head portion 14 to encourage movement of cuttings to the material handling aperture/s 44. The scraper elements can be replaced as needed.

Figure 9:
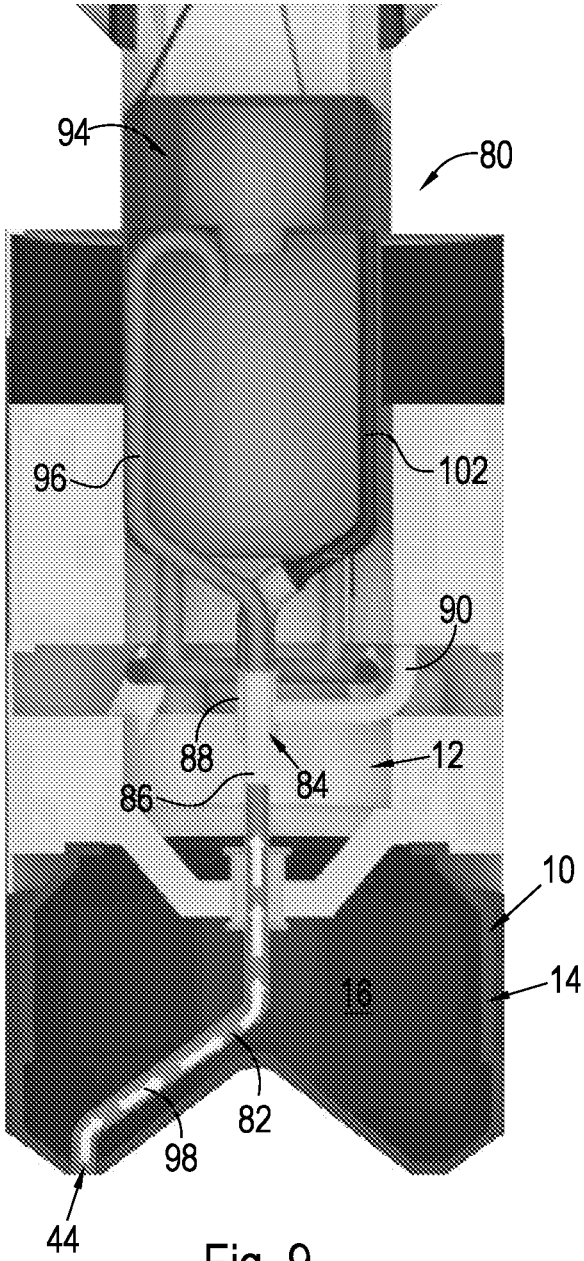
FIGS. 9 and 10 show a pilot shaft material handling arrangement according to a second aspect of the invention, at two different stages of the material handling procedure.
Figure 10:
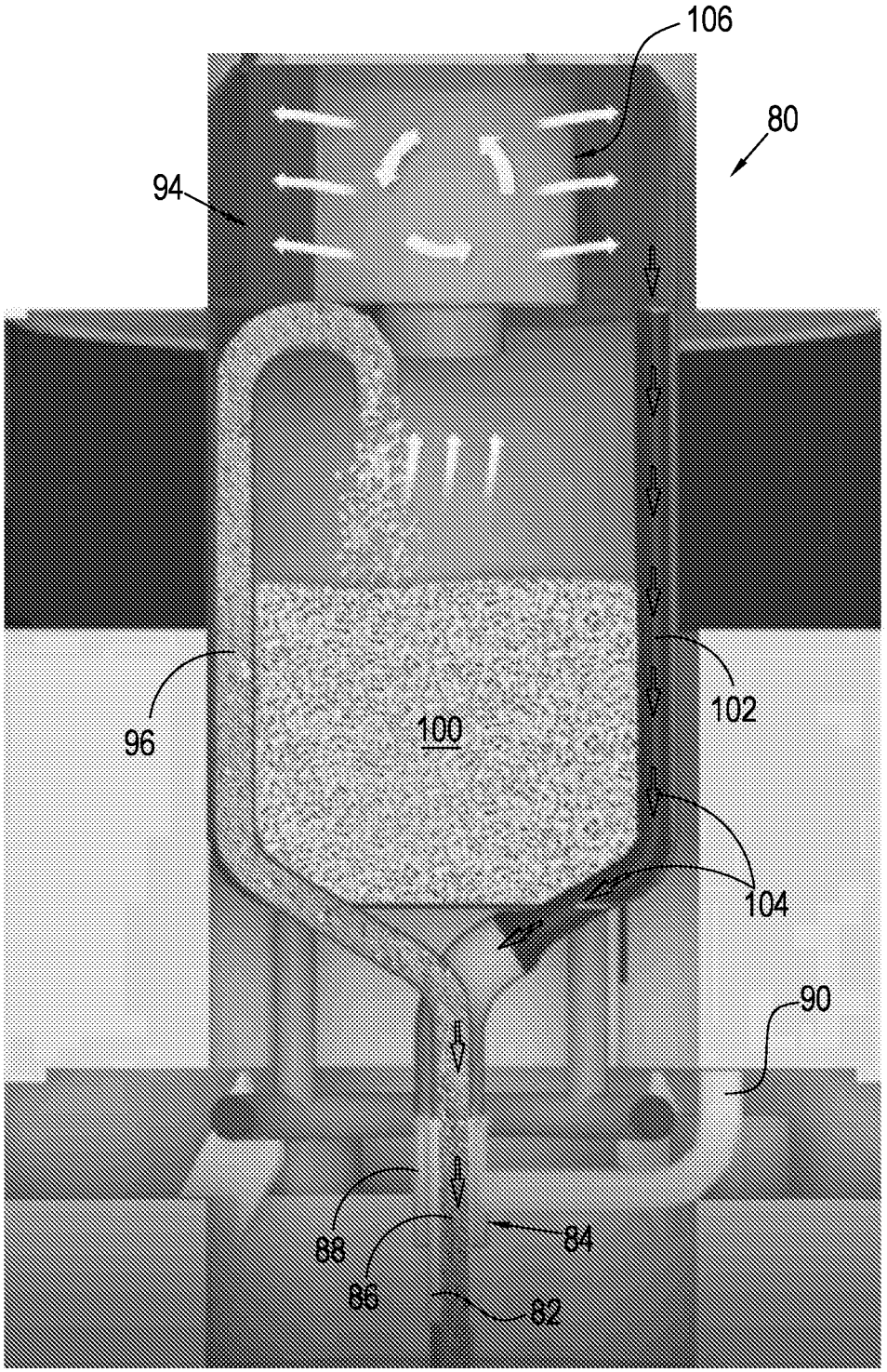

Turning now to FIGS. 9 and 10, the pilot shaft material handling arrangement 80 comprises a cutter head suction pipe 82 extending from the material handling aperture 44. The cutter head suction pipe 82 extends adjacent an inner face of the conical body 24 and then upwardly along the central axis of the cutter head portion 14. The end of the cutter head suction pipe 82 protrudes from the central connector aperture 19 of the connector portion 12.

In an embodiment, the end of the cutter head suction pipe 82 is fitted with a double walled swivel arrangement 84 that defines a first pipe 86 that is in communication with the cutter head suction pipe 82 and a second pipe 88 that leads into a cutter head blower pipe 90 that extends up to a vacuum unit 92 provided on an upper working stage of the shaft boring system 54, as shown in FIG. 8.

In an embodiment, the pilot shaft material handling arrangement 80 further comprises a kibble 94 that acts as a vacuum collector kibble that can be lowered through the shaft boring machine 50 and secured to the double walled swivel arrangement 84. The kibble 94 includes a kibble suction pipe 96 that is secured to the other end of the first pipe 86 of the double walled swivel arrangement 84 so as to be in material communication with the cutter head suction pipe 82. The swivel arrangement 84 allows material to be sucked away from the pilot hole being bored as the cutter head arrangement 10 rotates, via the cutter head suction pipe 82, as indicated by arrows 98 in FIG. 9. The material 100 accumulates within the relatively stationary kibble 94 via the kibble suction pipe 96, via the double walled swivel arrangement 84, as the cutter head arrangement 10 continues to rotate.

The kibble 94 further includes a kibble blower pipe 102 that is secured to the other end of the second pipe 88 of the double walled swivel arrangement 84 so as to be in fluid communication with the cutter head blower pipe 90. The kibble blower pipe 102 directs air from an upper region of the kibble 94, via the kibble blower pipe 102, into the cutter head blower pipe 90, via the second pipe 88 of the double walled swivel arrangement 84, and then out to the vacuum unit 92, as indicated by arrows 104.

In an embodiment, an upper region of the kibble 94 includes a filtering arrangement 106 to filter the dust resulting from the material collecting within the kibble 94. As a result, relatively clean air is conveyed through the kibble blower pipe 102 and then the cutter head blower pipe 90, and then finally up to the vacuum unit 92. Once the kibble 94 has collected sufficient material, the cutter head arrangement 10 stops rotating, to enable the kibble 97 to be hoisted up to surface where it will be emptied)

This material handling arrangement 80 ensures that the removal of material and related muck takes place very close to the wall being bored, which results in an extremely efficient machine.

The invention claimed is:

1. A cutter head arrangement for a blind or shaft sinking rock boring machine, the cutter head arrangement comprising:

a cutter head portion including a cutter head side wall to define a chamber surrounded by the cutter head side wall, a rim portion extending from the cutter head side wall, the rim portion defining a working, contact face of the cutter head portion, the rim portion defining at least one material handling aperture;

a recessed wall portion, in the form of a conical body, extending away from the rim portion inwardly into the chamber so as to be surrounded by the cutter head side wall, with the rim portion and/or the recessed wall portion being fitted with a plurality of cutter elements to enable the cutter head portion to bore a pilot hole in use.

2. The cutter head arrangement of claim 1, wherein the conical body of the recessed wall portion defines a conical recess, with the conical body accordingly defining an inwardly extending apex that terminates substantially in line with a central axis of the cutter head portion.

3. The cutter head arrangement of claim 2, wherein the cutter head side wall is substantially cylindrical and the cutter head portion includes a tapering peripheral wall that extends between the cutter head side wall and the rim portion, with the rim portion accordingly protruding from the cutter head side wall, so that the rim portion defines a circular rim portion.

4. The cutter head arrangement of claim 3, wherein a connector portion extends from the cutter head side wall to enable the cutter head arrangement to be secured to the boring machine, the connector portion including a substantially cylindrical connector head side wall extending from the cutter head side wall, with an end wall extending across an end of the connector head side wall, the end wall defining a substantially central connector aperture therein.

5. The cutter head arrangement of claim 4, wherein the head side wall is enlarged relative to the connector head side wall, with a step accordingly being defined between the cutter head side wall and the connector head side wall.

6. The cutter head arrangement of claim 4, wherein the at least one material handling aperture is connected to a pilot shaft material handling arrangement, the at least one material handling aperture extending between the contact face of the cutter head portion and the chamber surrounded by the cutter head side wall.

7. The cutter head arrangement of claim 6, wherein the pilot shaft material handling arrangement comprises a cutter head suction pipe extending from the material handling aperture, adjacent an inner face of the conical body and then upwardly along the central axis of the cutter head portion, with an end of the cutter head suction pipe protruding from the central connector aperture of the connector portion.

8. The cutter head arrangement of claim 7, wherein the end of the cutter head suction pipe is fitted with a double walled swivel arrangement that defines a first pipe that is in communication with the cutter head suction pipe and a second pipe that leads into a cutter head blower pipe that extends up to a vacuum unit provided on the shaft boring machine, wherein the pilot shaft material handling arrangement further comprises a kibble that acts as a vacuum collector kibble that can be lowered through the shaft boring machine and secured to the double walled swivel arrangement.

9. The cutter head arrangement of claim 8, wherein the kibble includes a kibble suction pipe that is secured to another end of the first pipe of the double walled swivel arrangement so as to be in material communication with the cutter head suction pipe, with the swivel arrangement allowing material to be sucked away from the pilot hole being bored as the cutter head arrangement rotates, via the cutter head suction pipe, and into the relatively stationary kibble via the kibble suction pipe.

10. The cutter head arrangement of claim 9, wherein the kibble includes a kibble blower pipe that is secured to another end of the second pipe of the double walled swivel arrangement so as to be in fluid communication with the cutter head blower pipe, with the kibble blower pipe directing air from an upper region of the kibble, via the kibble blower pipe, into the cutter head blower pipe, via the second pipe of the double walled swivel arrangement and out to the vacuum unit.

11. The cutter head arrangement of claim 10, wherein an upper region of the kibble includes a filtering arrangement to filter the dust resulting from the material collecting within the kibble, so that relatively clean air is conveyed through the kibble blower pipe and then the cutter head blower pipe and out to the vacuum unit.

12. The cutter head arrangement of claim 6, wherein the cutter elements are fitted on or proximate the rim portion and the recessed wall portion and the tapering peripheral wall.

13. The cutter head arrangement of claim 12, wherein the distance from the cutter head portion to a cutting face is spaced to ensure that the material that is being cut is of a predetermined size, with this spacing, together with the spacing and arrangement of the plurality of cutter elements, being used to predetermine the size of material cuttings so as to act as a sizing guide or arrangement to enable the size of the material cuttings to be controlled, to ultimately ensure that a suction pipe of the material handling arrangement does not become blocked by overly sized material cuttings.

14. The cutter head arrangement of claim 13, wherein a cutter element is provided in front of the material handling aperture to ensure that the material that moves through the material handling aperture is an appropriate size to prevent blockages.

15. The cutter head arrangement of claim 1, wherein the conical body of the recessed wall portion extends away from the rim portion at an angle of 35° into the chamber.

* * * * *